United States Patent [19]

Thayer et al.

[11] Patent Number: 4,536,371

[45] Date of Patent: Aug. 20, 1985

[54] CATALYTIC CONVERTER DIVIDER

[75] Inventors: Timothy Z. Thayer, Hope; Frank W. Shaw, Columbus, both of Ind.

[73] Assignee: Arvin Industries, Inc., Columbus, Ind.

[21] Appl. No.: 494,618

[22] Filed: May 16, 1983

[51] Int. Cl.[3] ..... B01D 50/00

[52] U.S. Cl. ..... 422/171; 60/299; 422/169; 422/176; 422/180

[58] Field of Search ..... 422/169, 171, 176, 180; 60/299

[56] References Cited

U.S. PATENT DOCUMENTS

| | | | |
|---|---|---|---|
| 3,090,677 | 5/1963 | Scheitlin et al. . | |
| 3,740,197 | 6/1973 | Scheitlin et al. . | |
| 3,771,969 | 11/1973 | Scheitlin . | |
| 4,020,539 | 5/1977 | Vroman | 60/299 X |
| 4,049,388 | 9/1977 | Scheitlin et al. . | |
| 4,218,422 | 8/1980 | Schock et al. | 422/171 |
| 4,239,733 | 12/1980 | Foster et al. | 422/171 X |
| 4,322,388 | 3/1982 | Hardin et al. . | |
| 4,425,304 | 1/1984 | Kawata et al. | 422/171 |

FOREIGN PATENT DOCUMENTS

| | | | |
|---|---|---|---|
| 849235 | 8/1970 | Canada | 422/171 |

*Primary Examiner*—Hiram H. Bernstein

*Assistant Examiner*—William R. Johnson

*Attorney, Agent, or Firm*—Barnes & Thornburg

[57] ABSTRACT

A catalytic converter includes a longitudinally disposed body portion having first and second shell halves and an interior in which first and second catalytic substrates are disposed. A divider is positioned between the first and second catalytic substrates and is selectively attachable to accommodate substrates of various relative sizes. The divider includes first and second divider halves, with each divider half having a pair of flanges which extend perimetrically and substantially completely along the interior wall of one shell half. The portion of the interior wall of each shell to which the divider flanges are attached has a greater longitudinal extent than the longitudinal extent of the pair of divider flanges to allow selective placement of the dividers in the converter body portion. The divider flanges are disposed substantially parallel to the interior wall and are coupled thereto. The divider flanges include a portion which is recessed inwardly from the interior wall. This portion provides a passageway between the substrates and first and second mating sections. The first mating section includes a stud and the second mating section includes an aperture. The aperture of the second mating section is sized and positioned to receive the stud of the first mating section.

10 Claims, 4 Drawing Figures

CATALYTIC CONVERTER DIVIDER

This invention relates to catalytic converters and specifically to converters having two or more catalytic substrates. The invention particularly relates to a divider which is selectively slidable in a catalytic converter housing for selective placement between catalytic substrates of various sizes.

Catalytic converters of the type with which this invention deals are known in the prior art. See, for example, Scheitlin U.S. Pat. No. 3,771,969; Scheitlin et al U.S. Pat. No. 3,740,197; Scheitlin et al U.S. Pat. No. 3,090,677; Scheitlin U.S. Pat. No. 4,049,388; and Hardin U.S. Pat. No. 4,322,388.

Typically, the catalysts in the catalytic converters are formed as substrate blocks which are placed into the converter housing. The relative size of the blocks varies depending on the amount of oxidizing or reducing capacity necessary in a particular vehicle. One difficulty which has arisen in the manufacture of substrate blocks is that they break easily if they are too long. If the substrate blocks are too long, they are also hard to plate with the catalytic material. Therefore, the substrate blocks are generally limited to six to six and one-half inches or less. In converters requiring more oxidizing or reducing capacity than that afforded by six to six and one-half inch blocks, it becomes necessary to use more than one substrate in a converter housing. For example, if a particular vehicle required the oxidizing capacity of a ten inch substrate block, it might be necessary to use a six inch oxidizing substrate block and a four inch oxidizing substrate block. Because the relative size of one substrate block to the other may vary, manufactures have heretofore used different converter housings for different size relationships of substrates. This is costly and requires inventories of various different converter housings.

One object of the instant invention is to provide a converter housing and a divider for various sizes of converter substrates.

Another object of the instant invention is to provide a substrate block divider which is selectively positioned in the converter housing between the substrates and which provides a gas passageway therebetween.

A further object of the instant invention is to provide a converter shell and substrate divider which is durable end less likely to fail under stress.

In accordance with the instant invention, a catalytic converter includes a longitudinally disposed body portion having first and second shell halves and an interior through which the combustion product can flow. The body of the converter also includes an inlet through which the combustion product can flow into the interior of the body, and an outlet through which the combustion product can flow out of the interior of the body. First and second catalytic substrates are disposed in the interior of the body. A selectively slidable divider is positioned in the interior of the converter body between the substrates. The divider has first and second divider halves. Each divider half includes a pair of flanges which extend perimetrally substantially completely along the interior wall of one shell half. The divider flanges are disposed substantially parallel to the interior wall. The divider flanges include a portion which is recessed inwardly from the interior wall providing a passageway between the substrates and first and second mating sections. Each shell half also includes a portion of the interior wall for attaching the pair of divider flanges to the interior wall of the shell. This portion of the shell halves is generally continuous to allow selective placement of the divider halves in the converter body to accommodate substrates of varous sizes. The divider flanges are coupled to this portion of the shell halves when the position of the divider between the substrates has been selected.

Preferably, the first mating section includes a stud and the second mating section includes an aperture. The aperture of the second mating section is sized and positioned to receive the stud of the first mating section.

One feature of the instant invention is that the body portion of the converter has no necked-down portion in the area of the body portion where the divider is placed. It has been found that mechanical and thermal stress on necked-down portions will often cause the converter to fail. Converter shell deterioration can be accelerated by the heat which builts up in this area. By eliminating the necked-down portion, a significant cause of catalytic converter failure can be reduced. Further, the use of a catalytic converter shell without a necked-down portion enables a single-sized shell to be used in a variety of applications. Converters for different vehicles often require different amounts of catalyst. The continuous straight-sided converter shell of the instant invention allows the manufacturer to vary the placement of the divider in the interior of the shell to accommodate substrates of various sizes. This feature enables the manufacturer to vary the amount of catalyst used in the converter, without forcing him to use a different-sized or shaped shell. The use of a single-sized and shaped shell can result in a cost saving to the manufacturer by eliminating the tooling cost which would be necessary to fabricate shells having different sizes.

It is also a feature of the instant invention that a divider is formed through the use of a pair of inverted divider halves. This use of identical divider halves placed in a head-to-tail relation has the advantage of reducing tooling and inventory costs to the manufacturer by reducing the number of different parts which the manufacturer needs to fabricate.

Additional features and advantages of the instant invention will become apparent to those skilled in the art upon consideration of the following detailed description of a preferred embodiment exemplifying the best mode of carrying out the invention as presently perceived. The detailed description particularly refers to the accompanying figures in which.

Figure 1:
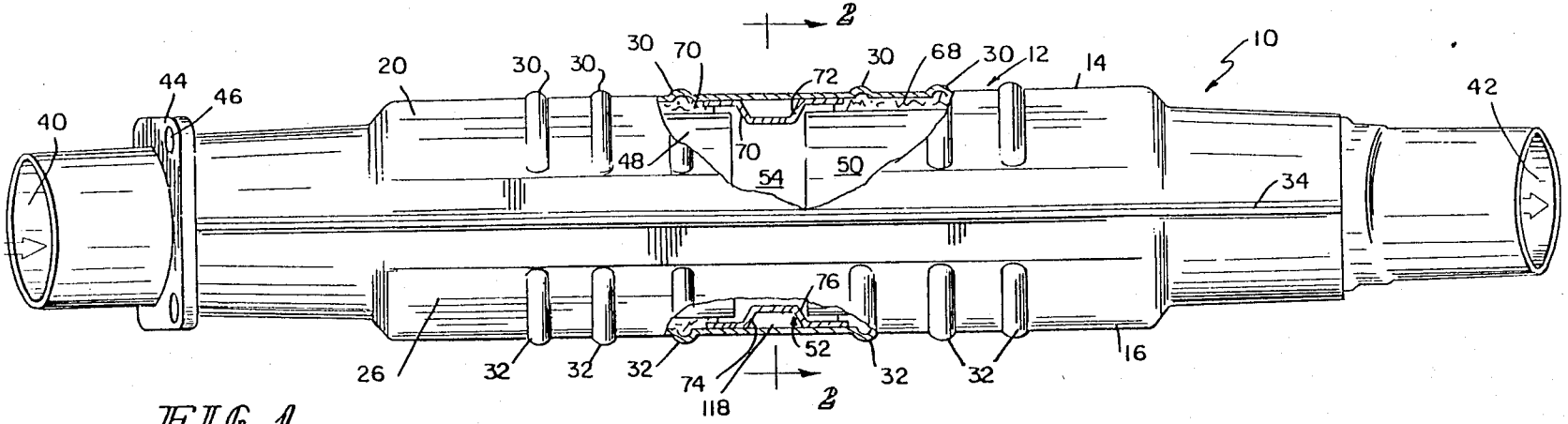
FIG. 1 is a side view, partially broken away, of the instant invention.
Figure 2:
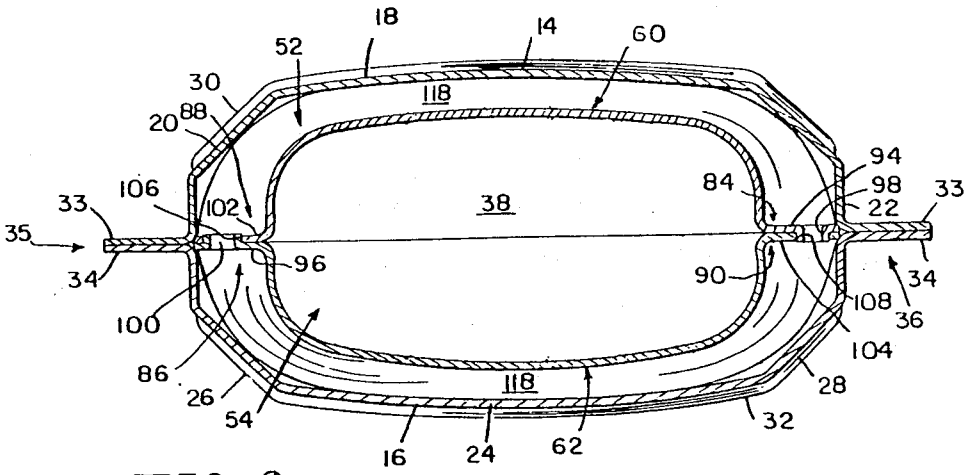
FIG. 2 is a cross-sectional view taken along lines 2—2 of FIG. 1.
Figure 4:
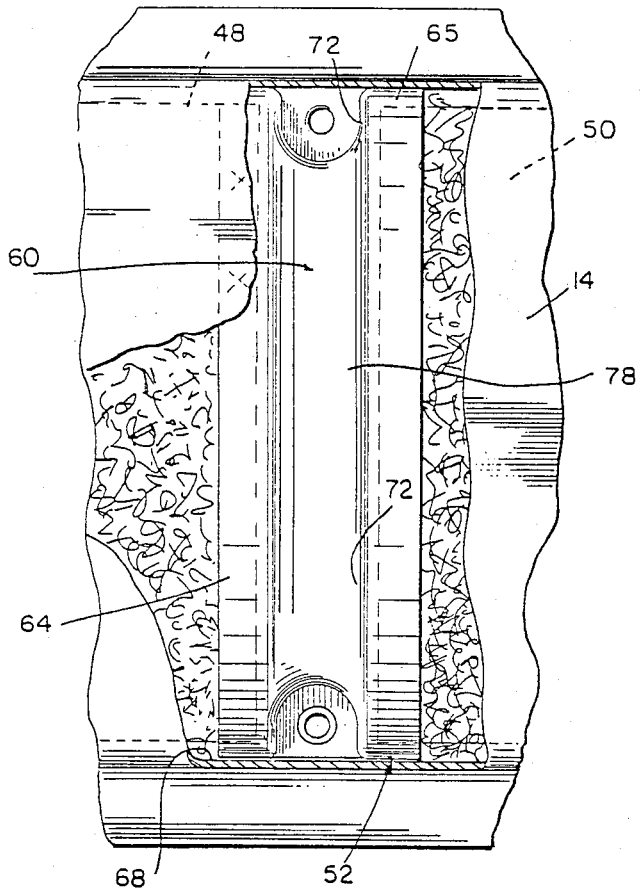
FIG. 4 is a partial, top planar view of the center section of the instant invention, partially broken away.
Figure 3:
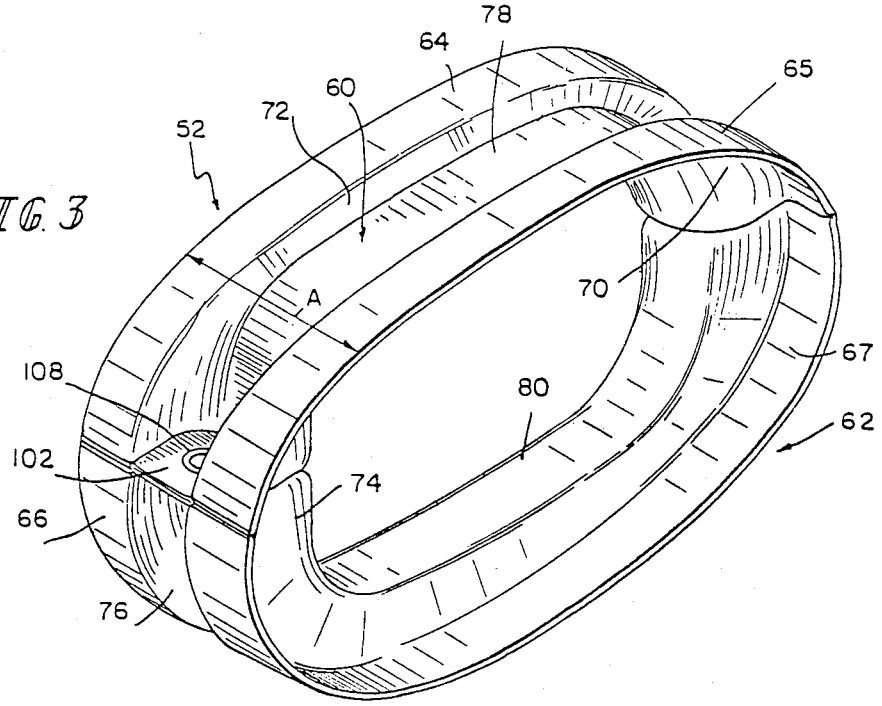
FIG. 3 is a perspective view of a divider constructed according to the instant invention.

The catalytic converter 10 shown in FIGS. 1–4 includes a longitudinally disposed body portion 12. Body portion 12 includes a first, upper shell half 14 and a second, lower shell half 16. First, upper shell half 14 includes a generally horizontally disposed upper exterior surface 18 and a generally vertically disposed side exterior surfaces 20, 22. Second, lower shell half 16 includes a generally horizontally disposed lower exterior surface 24 and a generally vertically disposed side exterior surfaces 26, 28.

A series of exteriorly convex stiffening ridges 30, 32 are stamped on first shell half 14 and second shell half 16, respectively, in a direction generally transverse to the longitudinal extent of body portion 12. Stiffening ridges 30, 32 are stamped into shell halves 14, 16 to add rigidity to the body 12 of converter 10.

Each shell half 14, 16 includes a pair of outwardly disposed flanges 33, 34, respectively. The outwardly disposed flanges 33 of first shell half 14 are welded or otherwise joined to the outwardly disposed flanges 34 of second shell half 16 to form seams 35, 36 which join the first shell half 14 to the second shell half 16.

When first shell half 14 is joined to second shell half 16, the converter has an interior 38 through which a combustion product can flow. An inlet 40 is provided at one end of body 12 through which the combustion product can flow into the interior 38 of body 12. An outlet 42 is disposed at the opposite end of body 12 through which the combustion product can flow out of the interior 38 of body 12. A mounting bracket 44 having a plurality of mounting holes 46 is provided near the inlet 40 end for mounting the converter 10 to a portion of the vehicle or to another portion of the exhaust system of the vehicle. A first 48 and second 50 catalytic substrate block are disposed in series in the body 12 interior 38. The combustion products which flow through the interior 38 of the converter 10 flow through the catalytic substrate blocks 48, 50, where the combustion products are either oxidized or reduced. The first catalytic substrate 48 is disposed in the interior 38 of the body 12 proximal to inlet 40 and of body 12. The second catalytic substrate 50 is disposed in the interior 38 of the body 12 converter 10 proximal to the outlet 42 end of body 12. First 48 and second 50 catalytic substrate blocks can be either both oxidizing catalysts, both reducing catalysts, or one of each.

A divider 52 is selectively positioned between substrates 48 and 50 of various relative sizes and provides a passageway 54 therebetween. Divider 52 includes a first divider half 60 and a second divider half 62. Divider halves 60, 62 are preferably identical and inverted to place the halves 60, 62 in a head-to-tail relation. First divider half 60 includes a first 64 and second 65 flange. Likewise, second divider half 62 includes a first 66 and second 67 flange. Flanges 64, 65 of first divider half 60 extend perimetrally substantially completely along the interior wall 68 of first shell half 14. Flanges 66, 67 of second divider half 62 extend perimetrally substantially completely along the interior wall 68 of second shell half 16. Flanges 64, 65 66, 67 are coupled to the interior wall 68 by spot-welding or other conventional means. when the divider has been selectively positioned in the body 12 to accommodate the substrates 48 and 50.

In the illustrative embodiment, the coupling of the flanges 64, 65, 66, 67 to interior wall 68 should be done so as to provide an airtight seal to prevent combustion product or air from flowing between interior wall 68 and the outwardly disposed surfaces of flanges 64, 65, 66, 67.

Preferably, the exteriorly concave ridges 30, 32 are spaced longitudinally on the shell half by a distance sufficient to permit flanges 64, 65, 66, 67 to be selectively moved in the body 12 between adjacent ridges. Although the flanges 64, 65, 66, 67 can be placed to overhang one of the ridges 30, 32, such placement of the flanges 64, 65, 66, 67 makes the spot-welding of the flanges 64, 65, 66, 67 more difficult.

The generally continuous interior wall 68, not having a neck-down portion, allows the selective positioning of the divider 52 along a substantial portion of the interior wall 68. The longitudinal extent of the interior wall 68 upon which the divider halves 60, 62 can be attached is greater than the longitudinal extent A of the divider 52 shown in FIG. 3 to allow selective placement of the divider in the body 12 to accommodate substrates 48 and 50 of various relative sizes. The convex stiffening ridges 30 and 32 allow the flanges 64, 65, 66, and 67 to slidably move along the interior wall 68 without obstruction. Through the use of this arrangement, the manufacturer can adapt a single-sized converter 10 to fit a wide variety of applications.

First divider half 60 includes a first 70 and second 72 inwardly disposed portion. Likewise, second divider half 62 includes a first 74 and second 76 inwardly disposed portion. First and second divider halves 60, 62 also include recessed portions 78, 80, respectively. The inwardly disposed portions 70, 72, 74, 76 and recessed portions 78, 80 help maintain the position of substrates 48, 50 and provide the passageway 54 between the substrate 48, 50 in the body 12 of the converter 10.

Each divider half 60, 62 also includes first, male mating sections 84, 86, respectively, and second, female mating sections 88, 90, respectively. As the divider halves 60, 62 are disposed in a head-to-tail arrangement, the male mating section 84 of first divider half 60 is disposed oppositely to the first, male mating section 86 of second divider half 62. Each male mating section 84, 86 includes a male mating flange 94, 96 and a hollow stud 98, 100. Each female mating section 88, 90 includes a female mating flange 102, 104 having an aperture 106, 108, respectively. The hollow stud 98 of the male mating section 84 of first divider half 60 is sized and positioned to be received by the aperture 108 of the female mating section 90 of second divider half 62. Likewise, the hollow stud 100 of the male mating section 86 of second divider half 62 is sized and positioned to be received by the aperture 106 of the female mating section 88 of first divider half 60.

Although the invention has been described in detail with reference to certain preferred embodiments and specific examples, variations and modifications exist within the scope and spirit of the invention as described and as defined in the following claims.

What is claimed is:

1. A clam shell type catalytic converter comprising a first shell half and a second shell half which are joined with a longitudinal perimetrical seam to form a body which defines a longitudinally extending body interior in which a first substrate and a second substate are disposed, an inlet disposed adjacent the first substrate, and an outlet disposed adjacent the second substrate, each shell half including an interior wall which defines an intermediate portion of the body having a generally constant transverse cross section, a ring-shaped divider comprising first and second C-shaped divider halves, each divider half including a pair of divider flanges extending comformably adjacent to the intermediate portion of the interior wall of one shell half, the divider flanges being disposed substantially parallel to the intermediate portion of the interior wall of one of the shell halves and including a portion between the flanges which is recessed inwardly from the interior wall of the one shell half, wherein the divider flanges are selectively attached to the linear interior walls at one of a plurality of locations along the intermediate portion of the interior walls to position the divider for accommodating substrates of various sizes.

2. The invention of claim 1, further comprising at least one exteriorly convex stiffening ridge formed into at least one of the first and second shell halves.

3. The invention of claim 1 wherein the divider is disposed transversely to said longitudinal perimetrical seam.

4. The invention of claim 1 wherein each of the first and second divider halves includes a first and second mating section, the first mating section of the first divider half includes a stud, and the second mating section of the second divider half includes an aperture sized and positioned to receive the stud of the first mating section of the first divider half.

5. The invention of claim 4 further comprising a stud in the first mating section of the second divider half and an aperture in the second mating section of the first divider half, the aperture in the second mating section of the first divider half being sized and positioned to receive the stud of the first mating section of the second divider half.

6. In a catalytic converter having a longitudinally disposed clam shell type body portion comprising first and second longitudinally extending shell halves having walls defining an interior through which a combustion product can flow, the body having an inlet through which the combustion product can flow into the interior of the body and an outlet through which the combustion product can flow out of the interior of the body, a first and second substrate through which the combustion product can flow, the first and second substrates being disposed in the interior of the body, the improvement comprising a divider which is selectively attached to the walls of the shell halves for accommodating the divider between the substrates, the divider having first and second C-shaped divider halves, each divider half including a pair of flanges extending comformably adjacent the interior wall of one shell half, the divider flanges being disposed substantially parallel to the interior wall and selectively attached thereto at one of a plurality of locations along the longitudinal extent of said interior wall to position the divider for accommodating substrates of various sizes.

7. In a clam shell type catalytic converter having a longitudinally disposed body portion comprising first and second shell halves defining an interior through which a combustion product can flow, the body having an inlet through which the combustion product can flow into the interior of the body and an outlet through which the combustion product can flow out of the interior of the body, and first and second catalytic substrates disposed in the interior of the body, the improvement comprising a ring-shaped divider which is selectively attached to the shell halves between the substrates, the divider having first and second C-shaped divider halves, each divider half including a pair of flanges extending comformably around the interior wall of one shell half, the divider flanges being disposed substantially parallel to the interior wall, the interior wall having a greater longitudinal extent than the longitudinal extent of the divider flanges to allow selective placement of the divider halves in one of a plurality of longitudinally different locations along the wall to accommodate substrates of various sizes, the divider flanges including first and second mating sections and a portion recessed inwardly from the interior wall thereby defining a passageway between the substrates, the first mating section of the first divider half including a stud, and the second mating section of the second divider half including an aperture, the aperture of said second mating section being sized and positioned to receive the stud of the first mating section.

8. The invention of claim 7 wherein the divider is attached closer to the inlet than to the outlet.

9. The invention of claim 7 wherein the divider is attached closer to the outlet than the inlet.

10. In a clam shell type catalytic converter having a first shell half and a second shell half which can be joined together so as to form a body having a longitudinally extending interior in which a first substrate and a second substrate are disposed, the improvement comprising an interior wall which defines an intermediate body portion having a generally constant transverse cross section, a ring-shaped divider comprising first and second C-shaped divider halves, with each divider half including a central portion and a pair of divider flanges, with at least one of the central portion and pair of divider flanges extending conformably adjacent to the intermediate body portion of the interior wall of one of the shell halves, wherein said at least one of the central portion and pair of divider flanges of each divider half is selectively attached to the intermediate portion of the interior wall of said one of the shell halves at one of a plurality of locations along the longitudinal extent of the intermediate portion of the interior wall so as to position the divider for accommodating substrates of various sizes.

* * * * *